US006097915A

United States Patent [19]

Fleck et al.

[11] Patent Number: 6,097,915

[45] Date of Patent: Aug. 1, 2000

[54] AC SCOROTRON

[75] Inventors: Thomas J. Fleck, Webster; Kenneth W. Pietrowski, Penfield; Jing qing Song, Webster, all of N.Y.

[73] Assignee: Xerox Corporation, Stamford, Conn.

[21] Appl. No.: 09/311,870

[22] Filed: May 14, 1999

[51] Int. Cl.[7] ..... G03G 15/02

[52] U.S. Cl. ..... 399/171; 361/230; 250/324

[58] Field of Search ..... 399/171, 172, 399/170, 311, 50; 250/324, 325, 326; 361/225, 230

[56] References Cited

U.S. PATENT DOCUMENTS 4,285,025 8/1981 Nishikawa ..... 361/230

5,613,172 3/1997 Pietrowski et al. ..... 250/324 X 5,655,186 8/1997 Godlove et al. ..... 399/171

*Primary Examiner*—Sophia S. Chen

*Attorney, Agent, or Firm*—Lloyd F. Bean, II

[57] ABSTRACT

In an electrostatographic imaging apparatus employing at least one charging device, scorotron which consists of one or more fine wires supported on insulated blocks spaced between the photoconductive surface and a conductive or insulative surface parallel to it. A screen or grid is interposed between the corona wires and the photoconductive surface and the grid is maintained at a potential roughly equal to the potential desired on the photoconductive surface. The scorotrons geometry, the individual wires are from ½ to 1½ inches apart and are spaced from the grid by about ¾ of an inch. Field enhancement electrode(s) are placed on the screen and are biased at the same potential as the screen. The field enhancement electrode(s) enhance electrical performance.

10 Claims, 9 Drawing Sheets

AC SCOROTRON

The present invention relates generally to a corona device primarily for use in reproduction systems of the xerographic or dry copying type, more particularly, concerning the utilization of field enhancement electrode to extend the charging capabilities of scorotrons.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

As discussed above, in electrostatographic reproductive devices it is necessary to charge a suitable photoconductive or reproductive surface with a charging potential prior to the formation thereon of the light image. Various devices have been proposed for the application of the electrostatic charge or charge potential to the photoconductive insulating body of Carlson's invention; one method of operation employs, for charging the photoconductive insulating layer, a form of corona discharge wherein an adjacent electrode comprising one or more fine conductive bodies maintained at a high electric potential causes deposition of an electric charge on the adjacent surface of the photoconductive body. Examples of such corona discharge devices are described in U.S. Pat. No. 2,836,725, to R. G. Vyverberg and U.S. Pat. No. 2,922,883, to E. C. Giamio, Jr. In practice, one corotron (corona discharge device) may be used to charge the photoconductor before exposure and another corotron used to charge the copy sheet during the toner transfer step. Corotrons are cheap, stable units, but they are sensitive to changes in humidity and the dielectric thickness of the insulator being charged. Thus, the surface charge density produced by these devices may not always be constant or uniform.

This problem is more acute wherein the electrophotographic marking process given above is modified to produce color images. One color electrophotographic marking process, called image on image processing, superimposes toner powder images of different color toners onto the photoreceptor prior to the transfer of the composite toner powder image onto the substrate. While image on image process has several benefits, it has several problems. For example, when recharging the photoreceptor in preparation for creating another color toner powder image it is important to level the voltages uniformly between the previously toned and the untoned areas of the photoreceptor in a manner that minimizes toner charge throughout the layer without reversing it's polarity.

One way of providing a more uniformly controlled charge is with the use of a screen controlled device called a scorotron which consists of one or more fine wires supported on insulated blocks spaced between the photoconductive surface and a conductive or insulative surface parallel to it. The conductive surface may be grounded or biased. A screen or grid is interposed between the corona wires and the photoconductive plate and the grid is maintained at a potential roughly equal to the potential desired on the plate. Typically in the scorotrons geometry, the individual wires are from ½ to 1½ inches apart and are spaced from the grid by about ¾ of an inch. In theory ions from the corona wires will pass between the grid wires and continue on to the plate as long as the potential difference between the grid and the plate exceeds a minimum value. Ideally, when the plate has reached sufficient charge that it is potentially matched to that of the grid, charging will cease. While these devices provide good control and excellent reproducibility of potential, they require power sources for both corona wires and the screen and, are typically bulky occupying considerable space in the machine.

SUMMARY OF THE INVENTION

Briefly, the present invention obviates the problems noted above by providing a In an electrostatographic imaging apparatus employing at least one charging device for charging a surface, said at least one charging device, including a corona producing element for generating charged ions; a grid biased at a grid potential, spaced from said corona producing element, for allowing ions to pass between the grid wires and continue on to the surface until the surface has reached sufficient charge approximating said grid potential; and an electrode, placed on said grid, coacting with said grid to enhance charge uniformity on said surface.

In as much as the art of electrophotographic printing is well known, the various processing stations employed in the printing machine will be shown hereinafter schematically and their operation described briefly with reference thereto.

DETAILED DESCRIPTION OF THE PRESENT INVENTION

Figure 1:
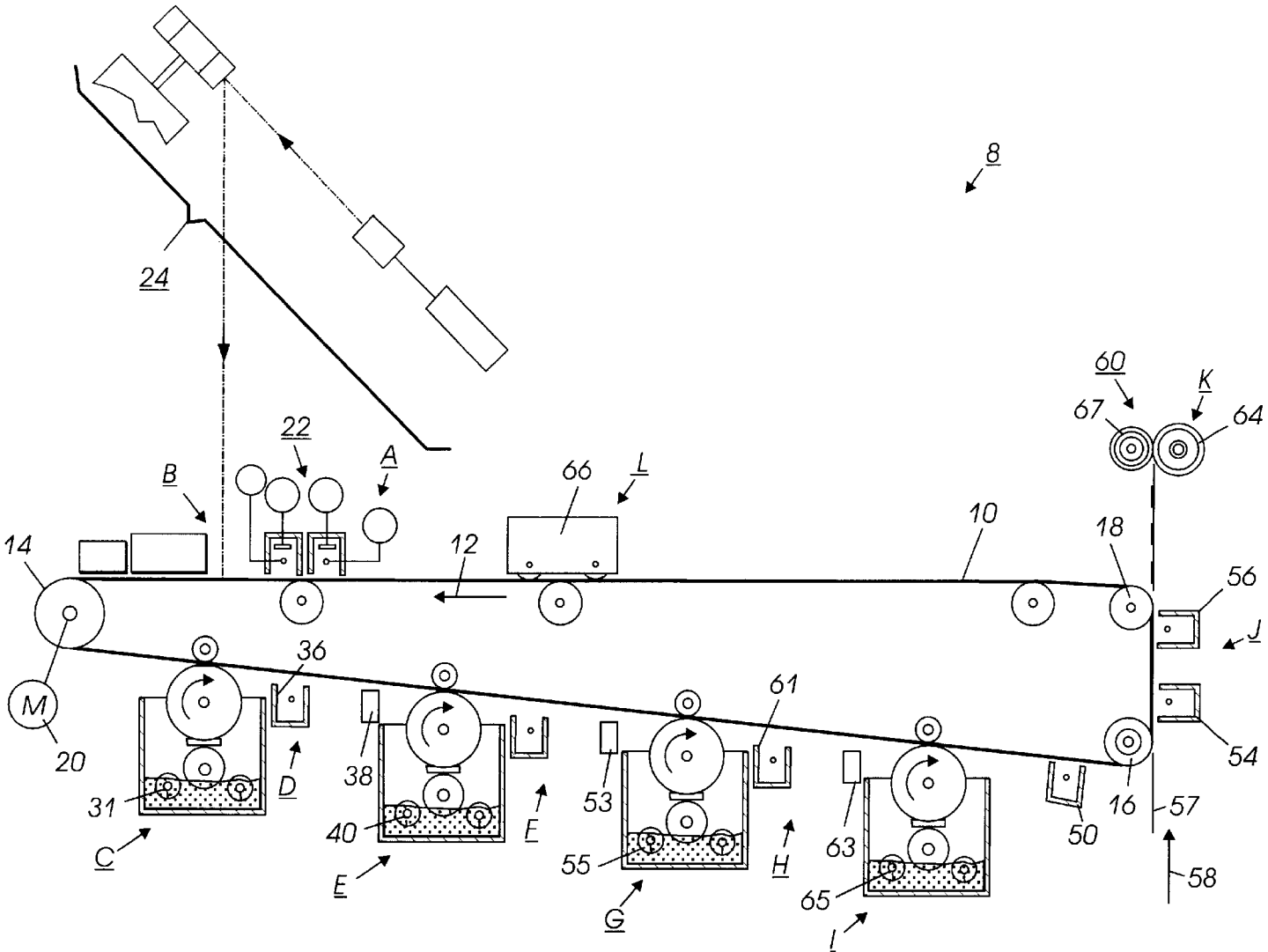
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2:
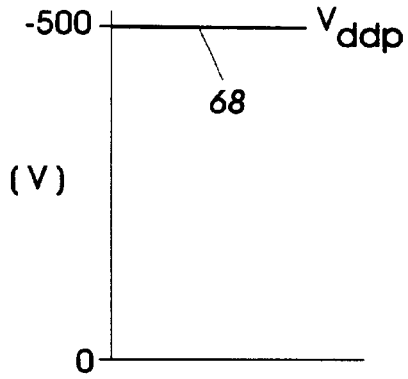
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device of the present invention is employed, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

Figure 3:
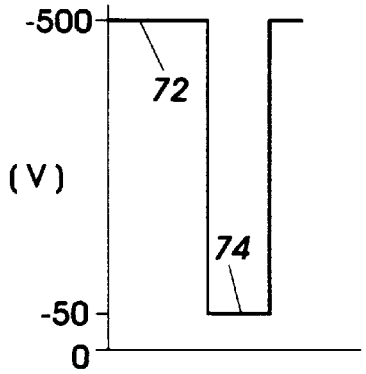
FIG. 3 shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

For the first development station C, the development system includes a donor roll which develops the image on the photoconductive surface.

Figure 4:
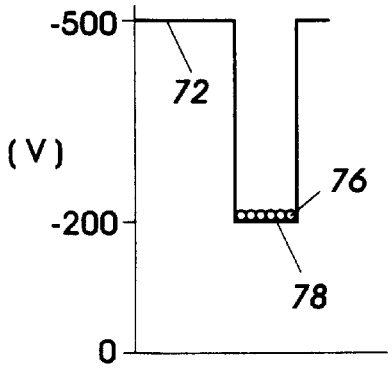
FIG. 4 shows a typical voltage profile of the image area after being developed.

FIG. 4 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at level 72 about −500.

After passing through the first development station C, the now exposed and toned image area passes to a first recharging station D. The recharging station D is comprised of a corona recharging device, a recharging device 36 of the present invention, which acts to recharge the voltage levels of both the toned and untoned parts of the image area to a substantially uniform level.

Figure 5:
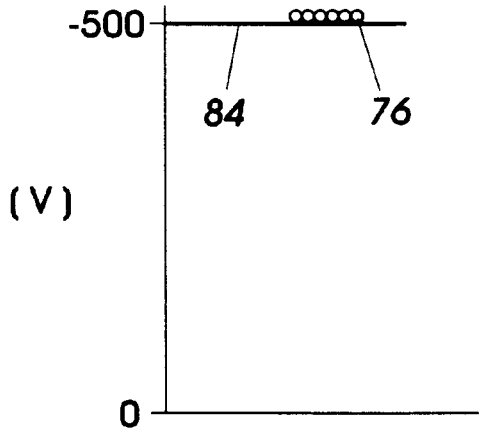
FIG. 5 shows a typical voltage profile of the image area after being recharged by a first recharging device.

FIG. 5 shows the voltages on the image area after it passes through the recharging device 36. The recharging device charges the image area.

Both the untoned parts and the toned parts (represented by toner 76) to a level 84 which is the desired potential of −500 volts, as shown in FIG. 5.

Figure 6:
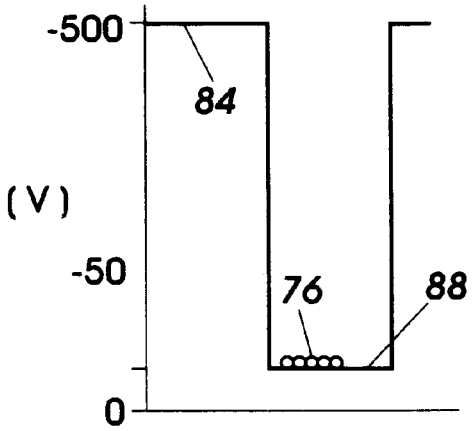
FIG. 6 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 6 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is substantially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has a recharging device, the device which operates similar to the recharging device 36.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes recharge device 61 which adjusts the voltage level of both the toned and untoned parts of the image area to a substantially uniform level in a manner similar to the recharging device 36 and recharging device 51.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level and polarity so as to ensure proper subsequent transfer.

After passing the corotron member 50, the four toner powder images are transferred from the image area onto a support sheet 57 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 57. This causes the negatively charged toner powder images to move onto the support sheet 57. The transfer station J also includes a detack corona device 56 which facilitates the removal of the support sheet 52 from the printing machine 8.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute, not shown, guides the support sheets 57 to a catch tray, also not shown, for removal by an operator.

After the support sheet 57 has separated from the photoreceptor belt 10, residual toner particles on the image area are removed at cleaning station L via a cleaning brush 4 contained in a housing 66. The image area is then ready to begin a new marking cycle.

The various machine functions described above are generally managed and regulated by a controller which provides electrical command signals for controlling the operations described above.

Figure 7:
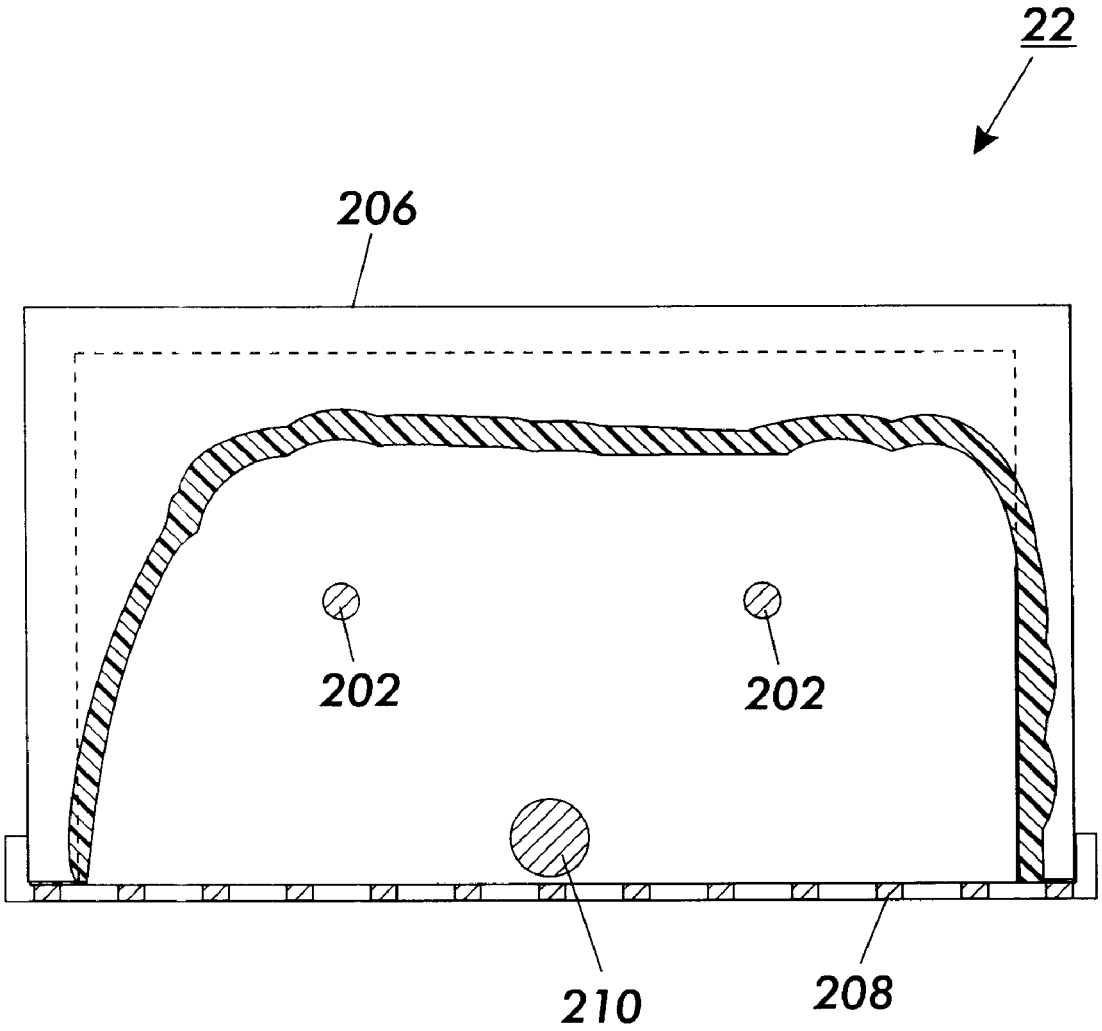
FIG. 7 is a front cross sectional view of an embodiment of the present invention.

Referring now to FIG. 7 in greater detail, in the present invention, a scorotron 22 which consists of one or more fine wires 202 supported on insulated blocks (not shown) spaced between the photoconductive surface and a conductive or insulative surface 206 parallel to it. A screen 208 or grid is interposed between the corona wires 202 and the photoconductive surface and the grid is maintained at a potential roughly equal to the potential desired on the photoconductive. The scorotrons geometry, the individual wires are from ½ to 1½ inches apart and are spaced from the grid by about ¾ of an inch. Enhancement electrodes 210 are placed on screen 208 and are biased at the same potential as the screen 208.

It has been found that at certain deterministic spatial frequencies the Recharge, Expose and Development image on image (REaD IOI) color process, for example, requires a level of voltage nonuniformity that cannot exceed a few volts. This requires that the charging device have uniform current emission and electrical performance that can compensate for variations in photoreceptor electrical and mechanical properties. This compensation is directly related to the current-voltage behavior of the device often referred to as the bareplate I–V characteristics. These characteristics are a static measurement of the magnitude of current delivered to a conductive equipotential plane placed beneath the device as a function of the potential difference between the scorotron DC grid bias and that which is applied to the conductive plane (plate voltage). Theoretically, the current to the conductive plane passes through zero when the grid-plate potential difference is zero. This point is referred to as the voltage intercept ($V_{intercept}$) and corresponds to the plate voltage where the current null occurs for a given grid bias.

The intercept voltage and the slope of the I–V curve are critical parameters effecting charging device performance as defined by the equation for an ideal dielectric:

$$V_{final}=V_{intercept}(1-e^{-S/Cv})+V_{in}e^{-S/Cv}$$

Where:

$V_{final}$=final charge potential on the dielectric $V_{in}$=initial dielectric surface potential presented to the charge device.

$V_{intercept}$~$V_{grid}$=conductive plate voltage at which the current passes through zero for a given grid voltage.

C=dielectric capacitance per unit area

V=process velocity

S=slope of the I–V characteristics

Scorotrons are employed when it is desirable to charge a media to a constant voltage such as in photoreceptor (P/R) charging, and recharge and pretransfer in the READ IOI process. Ideally this corresponds to $V_{intercept}$ the surface potential at which no further current is delivered to the media. Examination of the charging equation indicates that obtaining $V_{final}=V_{intercept}$ requires the quantity S/Cv to approach infinity. A practical rule of thumb is that $S/Cv \geqq 5$. Meeting this criteria with an ideal dielectric insures that $V_{final}=0.99\ V_{intercept}$. If C and v vary over some range due to variations in dielectric thickness and speed respectively, S must be large enough to compensate. Similarly it can be shown that if the $V_{in}$ presented to charge has a variation $\Delta V_{in}$ than $\Delta V_{final}=\Delta V_{in}e^{-S/Cv}$. Minimizing $\Delta V_{final}$ for a given $\Delta V_{in}$ requires that S/Cv be large. As the process speed increases, maintaining the $S/Cv \geqq 5$ relationship requires that S increase proportionately. This becomes an important consideration when it is desirable to extend the productivity of a base product to higher volume bands by increasing the process speed. Since the architecture is fixed the charging device size must remain the same. The critical parameters controlling the magnitude of S include the total corona current as controlled by the wire voltage, the grid to photoreceptor spacing, the coronode to grid spacing, grid open area (transmission) and the number of coronodes (wires). S increases with increasing corona current, grid open area and the number of wires. Similarly it increases with decreasing grid to photoreceptor and wire to grid spacings. Adding additional wires is generally not an option because more space is required. Increasing the nominal operating wire voltage or decreasing the wire to grid spacing is often not desirable because both can reduce the reliability by increasing the propensity for arcing. Similarly reducing the grid to photoreceptor spacing is not plausible because of photoreceptor flatness issues most notably in belt systems. Increasing the grid's open area to increase ion transmission reduces device robustness because the process is more susceptible to "viewing" corona "hot spots" caused by wire contamination etc., sources of nonuniform charging.

We have determined that placing circular enhancing electrode(s) on the grid midway between and parallel to the wires can increase corona current generation hence slop (S) of the I–V characteristics without sacrificing device reliability or robustness. FIG. 7 shows the cross section of a two wire AC scorotron configuration evaluated with a pretransfer. This device is relatively small with wire to wire and wire to grid separations of only 10 and 6 mm. respectively. The addition of a 1.78 mm. diameter field enhancement rod electrode midway between wires increased the slope of the I–V characteristics by approximately 20%. This enabled the desired scorotron electrical performance to be achieved within the space originally allocated to a smaller pin corotron.

Figure 8:
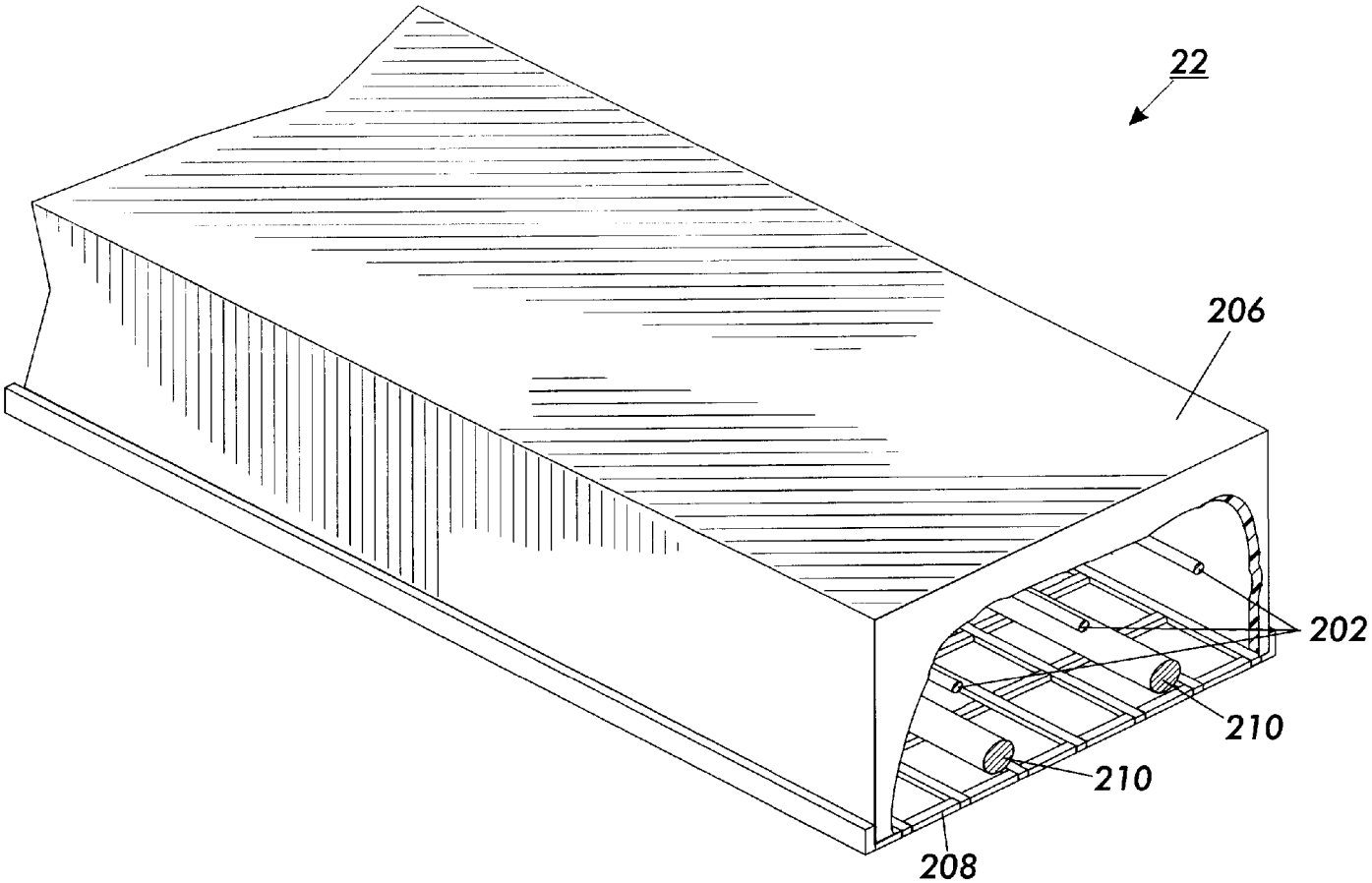
FIG. 8 is an entire view of an embodiment of the present invention.

FIG. 8 depicts a three wire configuration evaluated with an AC scorotron. Here the wire to wire and wire to grid spacings are larger namely 18 mm. and 9 mm. respectively. Adding two mm. diameter field enhancement electrodes midway between the 90 micron diameter wires increased the device slope (S) by approximately 10%. Measurements show that the arcing latitude was not compromised.

Figure 9:
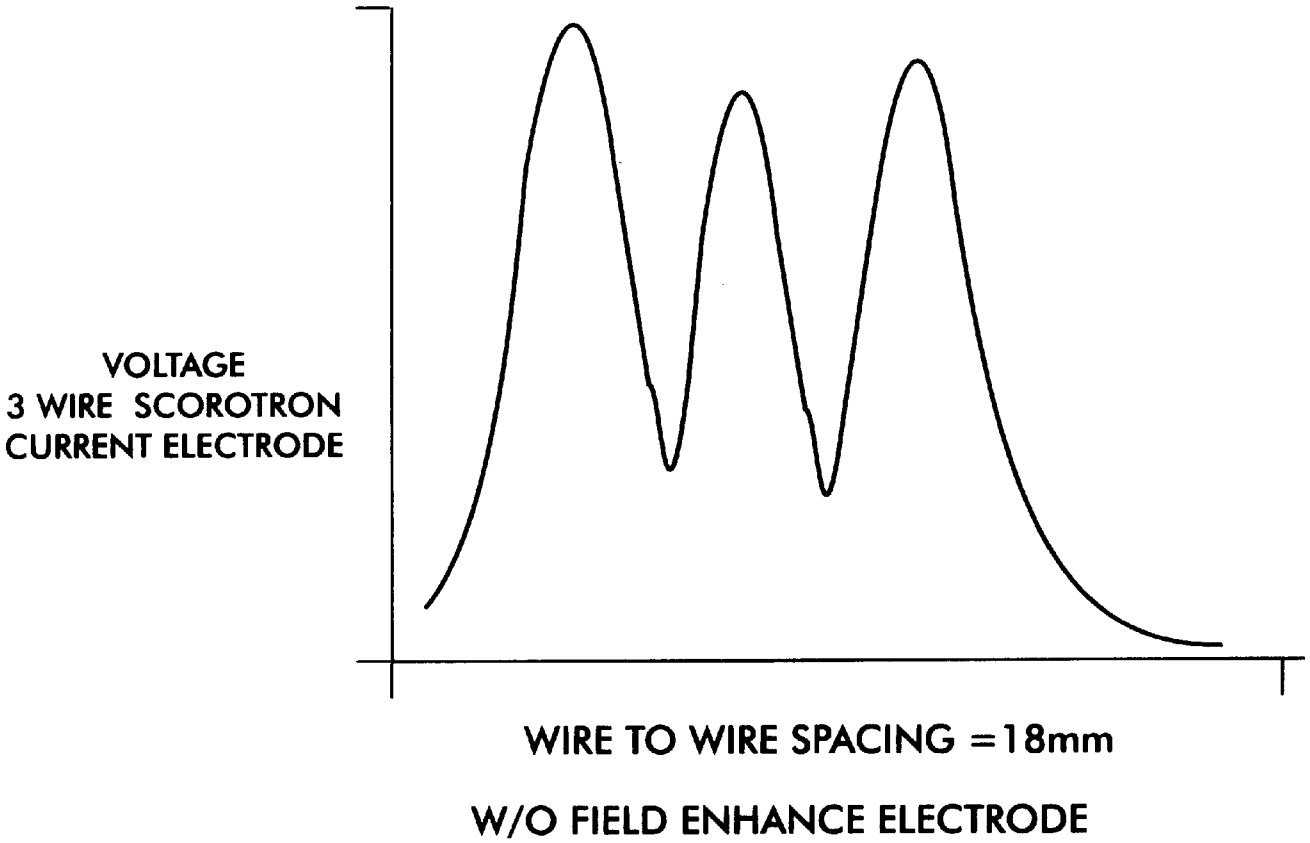
FIGS. 9–12 are experimental data comparing scorotron current profiles with and without field enhancement electrodes.
Figure 10:
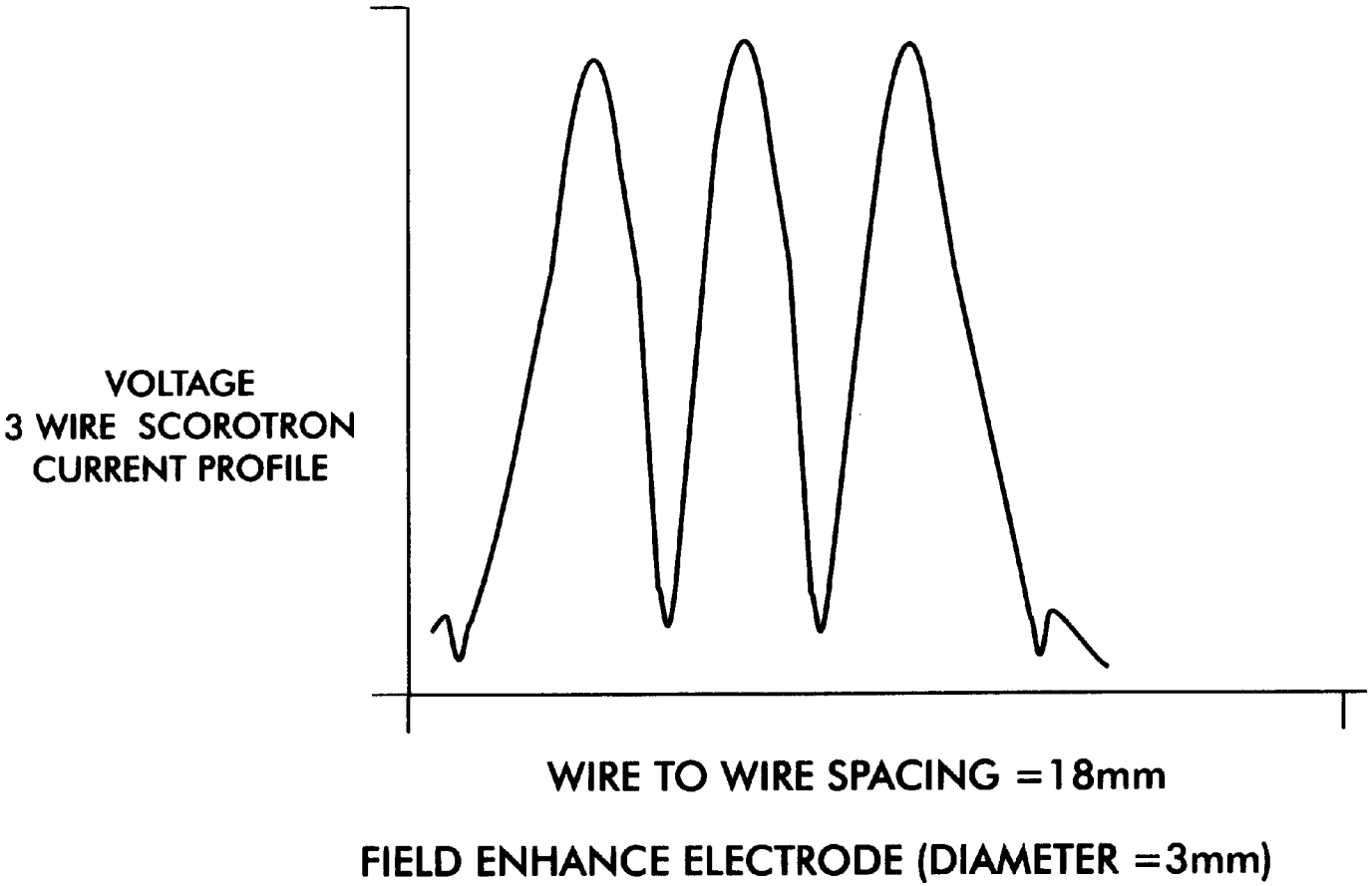

The effect of the enhancement electrodes in terms of minimizing wire to wire interactions in the form of filed suppression is illustrated in FIGS. 9 and 10. Shown is the current profile obtained with linear current sensing probe located in a ground plane in a direction parallel to the wires. The probe passes under the device in a direction perpendicular to the wires (process direction). The three peaks correspond to positions directly below the wires where the current density is the highest. FIG. 9 is the current profile without the filed enhancement electrodes. The current output of the middle wire is lower than the adjacent wires because its filed is suppressed by them. FIG. 10 illustrates the impact of adding 3 mm diameter filed enhancement electrodes. The current output at the same constant wire voltage (15.5 KV pp) increased for all wires and now the contribution of the middle wire is approximately equal to the other two.

Figure 11:
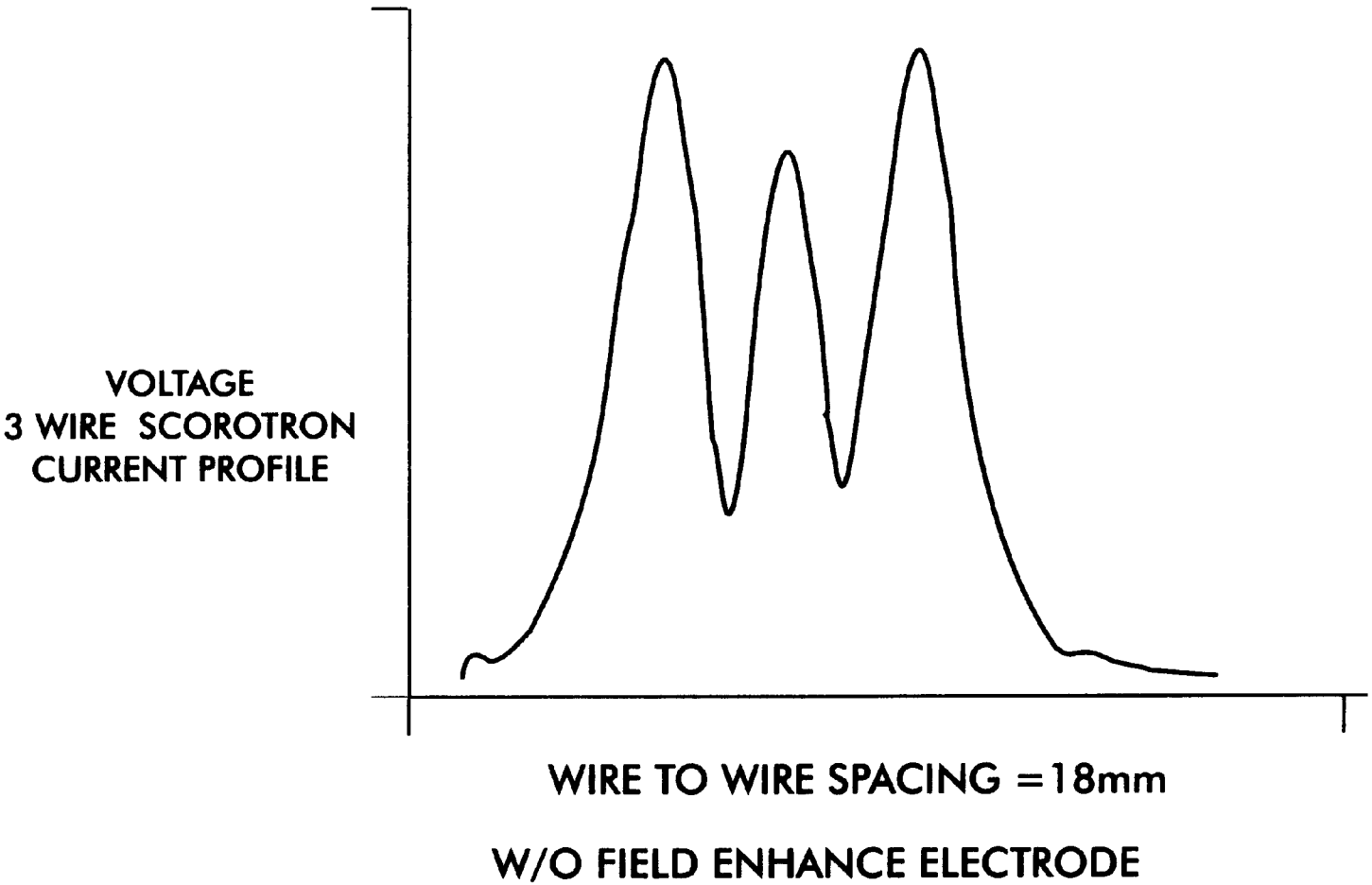
Figure 12:
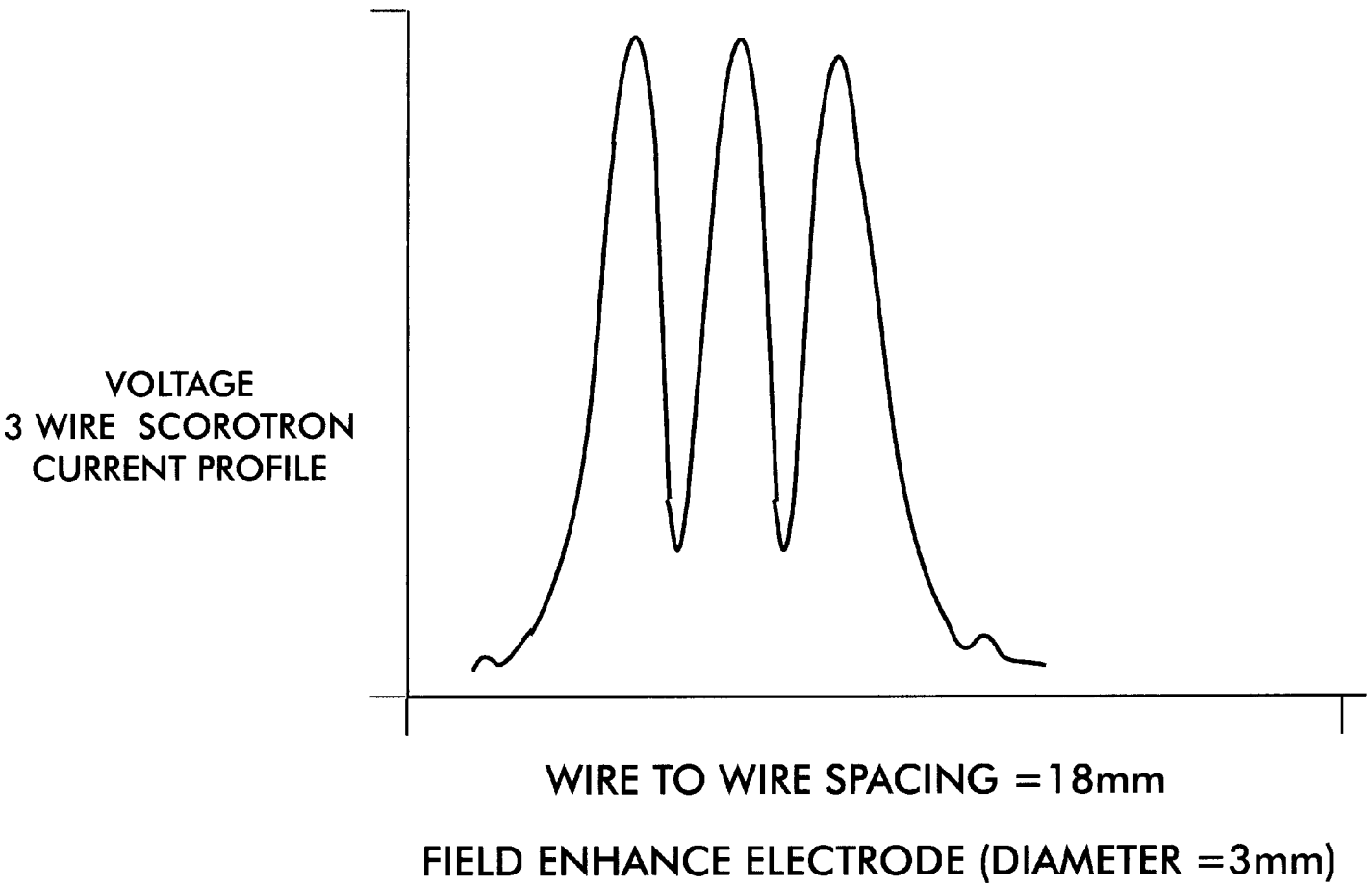

A similar set of curves is shown in FIGS. 11 and 12 for the same device with a smaller 15 mm. Wire to wire separation. The 3 mm. field enhancement electrodes had an even more pronounced impact on total current and equalizing the contribution of the middle wire. Since filed suppression between wires increases with decreasing wire to wire separation, it is anticipated that the field enhancement electrode effects will be more pronounced in geometries employing the smallest spacing. Care was taken in all these measurements to insure that the wire to electrode surface spacing was always greater than the wire to grid spacing. The optimum dimensions associated with this field enhancement electrode system will vary dependent on device geometry but the concept should be applicable to all multiple wire scorotron configurations.

Added benefits include lower operating voltages to achieve the same electrical behavior and an improvement in the uniformity of the corona emission in those geometries in which the current output of center wires is significantly suppressed. Regarding the latter, it is well known that a minimum linear current density must be maintained to achieve uniform corona emission. This is especially true in negative corona systems.

In recapulation, there has been provided a charging device with circular rod electrodes placed on the wire side of the grid in a multiple wire scorotron extending its charging capabilities at the same applied voltage and physical size without sacrificing arcing latitude. The circular electrode(s) placed on the grid approximately midway between and parallel to the wires minimizes the field suppression between adjacent wires enabling higher corona current generation at the same applied voltage. The higher current causes the I–V characteristic slope to increase enabling the device to accommodate higher process speeds with a smaller footprint. This performance enhancement concept is particularly beneficial for AC scorotrons where each polarity of current is generated only during a half cycle. Corona current in DC systems is generated continuously hence the maximum operating voltages are lower and more likely to have larger arcing latitude.

Other embodiments and modifications of the present invention may occur to those skilled in the art subsequent to a review of the information presented herein; these embodiments and modifications, as well as equivalents thereof, are also included within the scope of this invention.

We claim:

1. In an electrostatographic imaging apparatus employing at least one charging device for charging a surface, said at least one charging device, comprising:

a corona producing element for generating charged ions;

a grid biased at a grid potential, spaced from said corona producing element, for allowing ions to pass between the grid and continue on to the surface until the surface has reached sufficient charge approximating said grid potential; and an electrode, placed on said grid, coacting with said grid to enhance charge uniformity on said surface, said electrode is biased at said grid potential.

2. The apparatus of claim 1, wherein said corona producing element is a wire.

3. The apparatus of claim 2, further comprising a second electrode substantially equally space from both said first mentioned electrode and said wire.

4. The apparatus of claim 3, further comprising a second wire spaced from said first mentioned wire and substantially equally spaced from said second electrode.

5. The apparatus of claim 1, wherein said electrode is a circular rod having a diameter between 1 mm and 4 mm.

6. A charging device for charging a surface, comprising:

a corona producing element for generating charged ions;

a grid biased at a grid potential, spaced from said corona producing element, for allowing ions to pass between the grid and continue on to the surface until the surface has reached sufficient charge approximately said grid potential; and an electrode, placed on said grid, coacting with said grid to enhance charge uniformity on said surface, said electrode is biased at said grid potential.

7. The charging device of claim 6, wherein said corona producing element is a wire.

8. The charging device of claim 7, further comprising a second electrode substantially equally space from both said first mentioned electrode and said wire.

9. The charging device of claim 8, further comprising a second wire spaced from said first mentioned wire and substantially equally spaced from said second electrode.

10. A charging device for charging a surface, comprising:

a corona producing element for generating charged ions;

a grid biased at a grid potential, spaced from said corona producing element, for allowing ions to pass between the grid and continue on to the surface until the surface has reached sufficient charge approximating said grid potential; and an electrode, placed on said grid, coacting with said grid to enhance charge uniformity on said surface, said electrode is a circular rod having a diameter between 1 mm and 4 mm.

* * * * *